US005162036A

United States Patent [19]

Peter et al.

[11] Patent Number: 5,162,036

[45] Date of Patent: Nov. 10, 1992

[54] APPARATUS FOR MOVING APART SUCCESSIVE WEBS OF A SERIES OF WEBS HAVING SECTIONS IN ZIG-ZAG FORMATION

[75] Inventors: Jürgen Peter, Hamburg; Karl-Heinz Schlottke, Tangstedt, both of Fed. Rep. of Germany

[73] Assignee: E.C.H. Will GmbH, Hamburg, Fed. Rep. of Germany

[21] Appl. No.: 664,599

[22] Filed: Mar. 4, 1991

[30] Foreign Application Priority Data

Mar. 8, 1990 [DE] Fed. Rep. of Germany ..... 4007333

[51] Int. Cl.[5] ..... B65G 47/31; B65H 20/10

[52] U.S. Cl. ..... 493/416; 493/358; 198/419.2; 198/461; 271/183; 271/231

[58] Field of Search ..... 493/29, 357, 358, 362, 493/369, 416, 418, 450; 198/419.2, 419.3, 460, 461, 462; 271/182, 183, 229, 230, 231

[56] References Cited

U.S. PATENT DOCUMENTS

| | | | |
|---|---|---|---|
| 3,659,839 | 5/1972 | Baucke | 271/183 |
| 3,791,269 | 2/1974 | Sawada | 271/231 X |
| 4,201,102 | 5/1980 | Rudszinat . | |
| 4,273,324 | 6/1981 | Philipp | 271/231 X |
| 4,534,550 | 8/1985 | Reist | 271/183 |
| 4,546,871 | 10/1985 | Duke | 198/419.2 X |
| 4,708,332 | 11/1987 | Besemann . | |
| 4,842,573 | 6/1989 | Peter | 493/412 |
| 4,854,932 | 8/1989 | Schlottke | 493/357 |

FOREIGN PATENT DOCUMENTS 3738139 5/1989 Fed. Rep. of Germany .

*Primary Examiner*—Bruce M. Kisliuk
*Assistant Examiner*—John A. Marlott
*Attorney, Agent, or Firm*—Peter K. Kontler

[57] ABSTRACT

A continuous web of paper is subdivided into a series of discrete webs of finite length, and successive discrete webs of the series are provided with looped sections in zig-zag formation. Successive discrete webs of the series are moved forwardly and away from the next-following webs of the series while advancing toward a stacking station to thus establish between successive discrete webs gaps of predetermined width. The making of gaps involves advancing thé discrete webs with the upper reaches of three parallel foraminous endless belt conveyors which attract the webs and move them toward the stacking station. The median belt conveyor is accelerated when it is approached by the trailing end of a discrete web and then advances the trailing end at a speed exceeding the speed of the other conveyors and of the leader of the next-following discrete web. The median belt conveyor is thereupon disengaged from the accelerated discrete web and is decelerated so that it reassumes a predetermined starting position relative to the other belt conveyors.

13 Claims, 3 Drawing Sheets

Fig. 2a
Fig. 2b
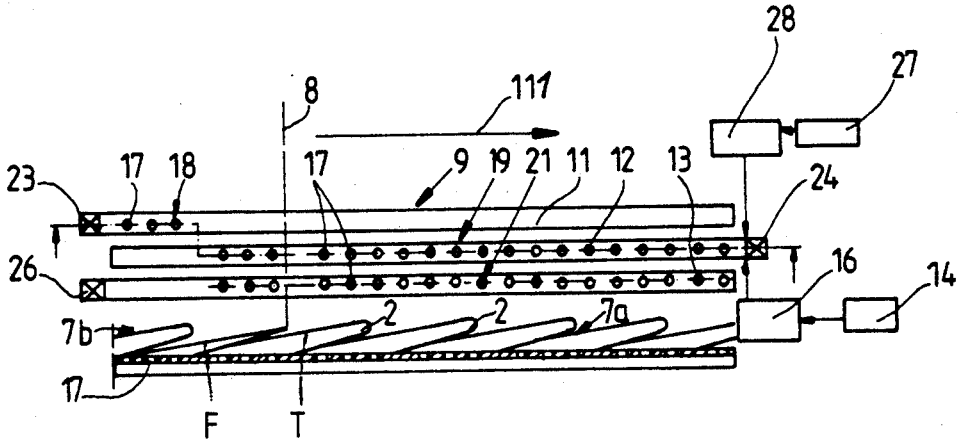
Fig. 3a
Fig. 3b
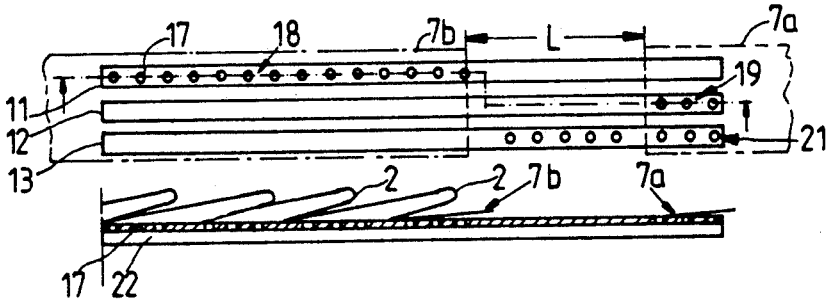
Fig. 4a
Fig. 4b
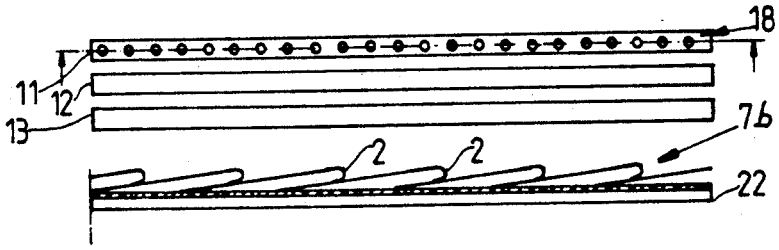
Fig. 5a
Fig. 5b
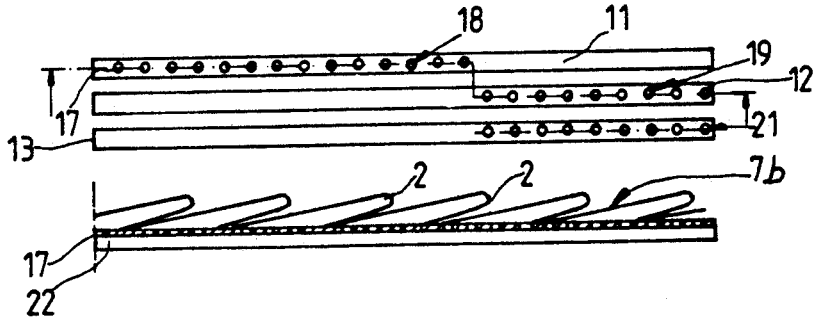

8
19
18
11
12
13
21
22
23
24
26
37
39
44
46
47
48
49
51
52
38
41
42
43
27
28
14
16
31
29
111
L
7a
7b

APPARATUS FOR MOVING APART SUCCESSIVE WEBS OF A SERIES OF WEBS HAVING SECTIONS IN ZIG-ZAG FORMATION

BACKGROUND OF THE INVENTION

The invention relates to improvements in apparatus for manipulating or processing a series of elongated webs which consist of paper or other flexible sheet material, especially for manipulating or processing successive webs of a series of discrete webs wherein each web consists of a series of sections in zig-zag formation. More particularly, the invention relates to improvements in apparatus for moving apart successive webs of a series of discrete webs, especially webs which advance from a first station where the webs are shaped to include sections in zig-zag formation to a station where the webs are stacked preparatory to storage or wrapping.

Published German patent application No. 37 38 139 discloses an apparatus wherein successive webs of a series of discrete webs of predetermined length are separated from the leader of a continuous web of paper or the like, and the thus separated webs of predetermined length are provided with sections in zig-zag formation. The sections are folded to convert their loops into pairs of coherent panels while the trailing end of a preceding web is separated from the leader of the next-following web in order to simplify the stacking operation which follows the establishment of gaps between successive webs. The webs are normally provided with transversely extending weakened portions to facilitate predictable folding between successive panels of the finished zig-zag formation.

OBJECTS OF THE INVENTION

An object of the invention is to provide a novel and improved apparatus which can move apart successive webs of a series of webs consisting of paper or other flexible sheet material in a predictable manner and while the webs are caused to advance at an elevated speed.

Another object of the invention is to provide an apparatus which can establish clearances or gaps of predetermined width between successive webs of a series of discrete webs while the webs advance from a zig-zag folding station to a stacking station for webs in zig-zag formation.

A further object of the invention is to provide the apparatus with novel and improved means for advancing the webs of a short or long series of discrete webs along their path between a zig-zag folding station and a stacking station.

An additional object of the invention is to provide an apparatus wherein the components which accelerate successive webs to establish clearances or gaps between the trailing ends of preceding webs and the leaders of next-following webs can form part of the web advancing or transporting system.

A further object of the invention is to provide novel and improved conveyors for use in the above outlined apparatus.

Another object of the invention is to provide a novel and improved method of manipulating successive webs of a series of discrete webs between a zig-zag folding station and a stacking or other treating station.

SUMMARY OF THE INVENTION

The invention is embodied in an apparatus for processing a series of elongated webs which consist of paper or other flexible sheet material and each of which has a leader and a trailing end. The apparatus comprises means for advancing the series of discrete webs in a predetermined direction along a predetermined path wherein the leader of each following web is adjacent the trailing end of the respective preceding web, and means for accelerating successive webs of the series in a predetermined portion of the path to thereby establish a clearance or gap of predetermined width between the trailing end of the accelerated web and the leader of the next-following web. The apparatus preferably further comprises means for providing successive webs of the series with sections in zig-zag formation in a second portion of the path upstream of the predetermined portion.

The accelerating means can include means for engaging successive webs of the series at least in the regions of trailing ends of the respective webs, and means for periodically activating the accelerating means.

The accelerating means can form part of the advancing means, and the advancing means can comprise a plurality of elongated neighboring parallel foraminous endless belt conveyors. One of these conveyors forms part of the accelerating means. The conveyors can include parallel elongated web-attracting reaches or stretches which are provided with groups of suction ports. The groups of suction ports are preferably staggered relative to each other in the region of the trailing ends of those webs which have trailing ends in the predetermined portion of the path. The group of suction ports in the one conveyor is preferably located downstream of the groups of suction ports in each other conveyor prior to acceleration of a web of the series. The apparatus further comprises variable-speed means (e.g., stacking means for webs having sections in zig-zag formation) for treating successive webs in a further portion of the path downstream of the predetermined portion. The accelerating means of such apparatus preferably further comprises synchronizing means including means for periodically varying the speed of the one conveyor and of the treating means.

In accordance with a presently preferred embodiment, the advancing means comprises at least three endless foraminous belt conveyors including the one conveyor and two additional conveyors which flank the one conveyor. The accelerating means of such apparatus further comprises means for driving the one conveyor at a plurality of speeds including a higher speed which exceeds the speed of the additional conveyors and a lower speed which is less than the speed of the additional conveyors. The advancing means of such apparatus further comprises means for driving the additional conveyors at a speed (e.g., a constant speed) which is below the higher speed of the one conveyor but above the lower speed of the one conveyor. The means for driving the one conveyor includes means for advancing the group of suction ports in the one conveyor forwardly and beyond the other groups of suction ports from a predetermined starting position while the one conveyor is driven at the higher speed and for returning the group of ports in the one conveyor to the predetermined starting position relative to the other groups of suction ports as a result of driving the one conveyor at the lower speed.

The groups of suction ports in the one conveyor and in one of the additional conveyors can be located downstream of the group of suction ports in the other additional conveyor. The advancing means of such apparatus further comprises a suction generating device which is in uninterrupted communication with the group of suction ports in the one additional conveyor. This suction generating device or another suction generating device can cooperate with means for periodically connecting the suction generating device to the groups of suction ports in the one conveyor and in the other additional conveyor.

Each group of suction ports can include at least one row of three suction ports, and the ports of each row are preferably spaced apart from each other in the predetermined direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 2*a* is an enlarged plan view of a detail as seen in the direction of arrow II in FIG. 1;

FIG. 2*b* is a vertical sectional view substantially as seen in the direction of arrows from the line II—IIb in FIG. 2*a;*

FIG. 3*a* shows certain parts of the structure of FIG. 2*a* but with one median endless belt conveyor shifted relative to the two additional belt conveyors;

FIG. 3*b* is a vertical sectional view substantially as seen in the direction of arrows from the line IIIb—IIIb of FIG. 3*a;*

FIG. 4*a* is a plan view similar to that of FIG. 2*a* or 3*a* but showing the conveyors in different positions;

FIG. 4*b* is a vertical sectional view substantially as seen in the direction of arrows from the line IVb—IVb of FIG. 4*a;*

FIG. 5*a* is a plan view similar to that of FIG. 2*a*, 3*a* or 4*a*, with the conveyors shown in the positions corresponding to those in FIG. 3*a;*

FIG. 5*b* is a vertical sectional view substantially as seen in the direction of arrows from the line Vb—Vb of FIG. 5*a.

DESCRIPTION OF PREFERRED EMBODIMENTS

The apparatus which is shown in FIGS. 1 to 5*b* serves to manipulate a series of elongated webs 7*a*, 7*b* . . . of paper or other flexible sheet material. The webs 7*a*, 7*b* . . . are obtained by repeatedly severing a continuous web 1 at a severing station 6 which can accommodate a mechanism known as a cross cutter. A suitable cross cutter is described and shown, for example, in U.S. Pat. No. 4,201,102 granted May 6, 1980 to Rudszinat. Successive webs 7*a*, 7*b* . . . of finite length are thereupon provided with loops 2 of the type shown in FIGS. 2*b*, 3*b*, 4*b* and 5*b* preparatory to stacking at a station 29. During transport from the severing station 6 to the stacking station 29, successive webs of finite length are moved apart to establish between them clearances or gaps L of predetermined width. The gap L between the webs 7*a* and 7*b* is shown in FIGS. 3*a* and 3*b*. The web 7*b* is or can be severed from the continuous web 1 subsequent to formation of the gap L between the webs 7*a* and 7*b*.

Figure 1:
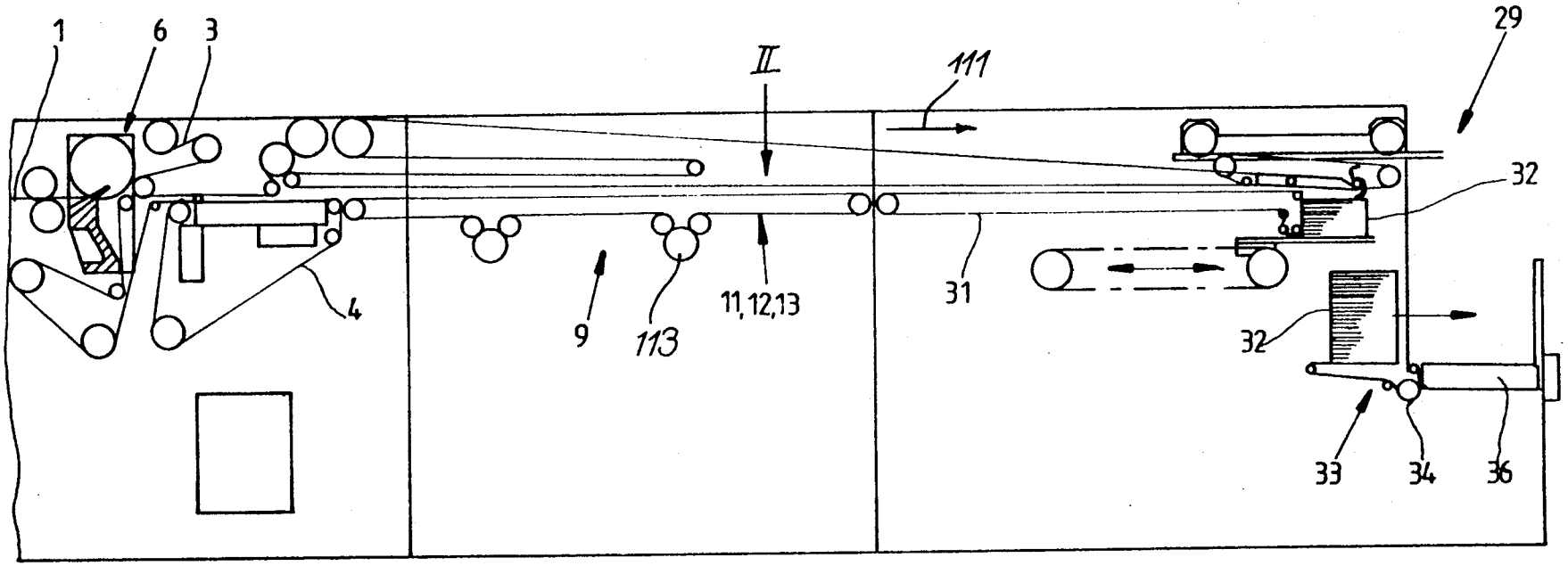
FIG. 1 is a schematic partly elevational and partly vertical sectional view of an apparatus which embodies one form of the invention.

As a rule, the apparatus which is shown in FIG. 1 will be designed to simultaneously process several continuous webs 1, i.e., to simultaneously form several series of webs 7*a*, 7*b* . . . of finite length. The webs of each such series are caused to advance between a discrete severing station 6 and a discrete stacking station 29. FIG. 1 merely shows a single severing station 6, a single stacking station 29, and single advancing means 9 for moving a single series of webs 7*a*, 7*b* . . . of finite length along an elongated path in a direction to the right, as viewed in FIG. 1 (note the arrow 111). The continuous web 1 which is shown in FIG. 1 can have a width which is several times the width of a web 7*a* or 7*b*, and such relatively wide continuous web is split into two or more narrower continuous webs prior to subdivision of each narrower continuous web into a series of discrete webs 7*a*, 7*b* . . . of finite length.

The web 1 is provided with transversely extending weakened portions (e.g., with rows of perforations) to facilitate conversion of discrete webs 7*a*, 7*b* . . . into a series of coherent sections or loops 2 which are connected to each other by weakened portions and together constitute zig-zag formations ready to be converted into stacks 32, one from each zig-zag formation, i.e., one from each of the webs 7*a*, 7*b* . . . The means for converting each discrete web of finite length into a zig-zag formation includes two endless belt conveyors 3, 4 which are located downstream of the severing station 6 and are driven at different speeds in order to form sections or loops 2 each of which includes two overlapping panels. The webs 7*a*, 7*b* can be provided with sections 2 while still adhering to the continuous web 1. The manner of converting webs into sections which together constitute zig-zag formations is disclosed in numerous United States and foreign patents of the assignee of the present application. Reference may be had, for example, to U.S. Pats. No. 4,708,332 (granted Nov. 24, 1987 to Besemann), 4,842,573 (granted Jan. 27, 1989 to Peter et al.) and 4,854,932 (granted Aug. 8, 1989 to Schlottke et al.)

FIGS. 2*a* and 2*b* show two neighboring webs 7*a*, 7*b* of a series of such webs each of which has a predetermined length necessary to accumulate a stack 32 from a predetermined number of panels in zig-zag formation. The trailing end T of the preceding web 7*a* is immediately adjacent the leader or front end F of the web 7*b*. As mentioned above, the web 7*b* can still adhere to the web 1. The purpose of treatment in a predetermined path portion between the stations 6 and 29 is to increase the distance between the trailing end T and the leader F from zero to a predetermined distance, i.e., to form a clearance or gap L of predetermined width The vertical broken line 8 denotes in FIG. 2*a* the locus where the continuous web 1 was cut at the station 6 to sever the preceding web 7*a* from the next-following or trailing web 7*b*, i.e., from the front portion of the web 1.

The means 9 for advancing the webs 7*a*, 7*b* . . . along the path which extends from the station 6 to the station 29 is designed in such a way that the distance between the trailing end T of the web 7*a* and the leader F of the web 7*b* is zero during the initial stage of movement away from the station 6 (see FIGS. 2*a* and 2*b*). Such advancing means comprises three endless foraminous belt conveyors 11, 12 and 13 having neighboring parallel upper reaches which serve to advance the webs toward the station 29. The median conveyor 12 further serves as a component of means for periodically accelerating successive discrete webs 7*a*, 7*b* . . . by causing them to move faster than the webs behind them in order to establish gaps L of predetermined width. The direction in which the advancing means 9 transports the webs of finite length away from the severing station 6 is indicated by the arrow 111. The establishment of gaps L is desirable and advantageous because this ensures that the leader F of a trailing web 7*b* cannot interfere with stacking of sections 2 which form part of the preceding webs 7*a* when the leader F of the web 7*b* approaches the stacking station 29.

The advancing means 9 further comprises means (such as the main prime mover 43 of FIG. 6) for driving the two outer or additional conveyors 11, 13 (and at certain times the median conveyor 12) at a substantially constant speed in such a way that the upper reaches of the conveyors advance in the direction of arrow 111.

The means for driving the median conveyor 12 (which forms part of the means for accelerating successive webs of finite length on their way toward the stacking station 29) comprises a first motor 14 for a transmission or differential 16 which can move the upper reach of the conveyor 12 at a speed higher than the speed of the conveyors 11, 13. Such driving means further comprises a second motor 27 and a differential or transmission 28 which can drive the conveyor 12 at a speed less than the speed of the conveyors 11 and 13.

The conveyors 11, 12 and 13 are formed with rows or groups of suction ports 17 which are spaced apart from each other in the direction of arrow 111. A first row 18 of three uniformly spaced-apart suction ports 17 is shown in the upper reach of the conveyor 11 (see FIG. 2*a*) behind and spaced apart from the line 8. The row or group 19 of three suction ports 17 in the median conveyor 12 is adjacent a similar row 21 of three suction ports 17 in the conveyor 13. FIG. 2*a* shows that the suction ports 17 of the rows or groups 19 and 21 are staggered with reference to the suction ports 17 of the row or group 18 when the median conveyor 12 assumes a starting position preparatory to acceleration of the web 7*a* so as to establish a gap L which separates the trailing end T of the web 7*a* from the leader F of the web 7*b*.

The upper reaches of the conveyors 11, 12, 13 are disposed above suction chambers 22 which constitute suction generating devices and each of which can be connected to the intake of a fan 37 (FIG. 6), suction pump or the like. FIG. 2*a* further shows valves 23, 24, 26 which can be manipulated to connect the respective suction chambers 22 to, or to seal such suction chambers from, the intake of the fan 37.

The mode of operation of the apparatus including the parts which are shown in FIGS. 1, 2*a* and 2*b* is as follows:

In FIGS. 2*a* and 2*b*, the median conveyor 12 is located in a starting position with reference to the additional conveyors 11 and 13. At such time, the leader F of the trailing web 7*b* is immediately adjacent the trailing end T of the preceding web 7*a*, i.e., the width of the gap is zero. The valve 26 is closed so that the suction ports 17 of the row or group 21 in the conveyor 13 are disconnected from the respective suction chamber 22 and are ineffective, i.e., the group 21 of ports 17 does not attract the web 7*a* and/or 7*b* to the conveyor 13. The valves 23 and 24 are open, i.e., the suction ports 17 of the rows or groups 18, 19 enable the upper reaches of the conveyors 11 and 12 to attract the adjacent portions of the webs 7*b* and 7*a*, respectively. The leader F of the web 7*b* is pulled in the direction of arrow 111 at the speed of the conveyor 11 (which is driven by the pulley 113) and at the (then) speed of the conveyor 12. At such time, the speed of the conveyor 12 matches the speed of the conveyor 11.

The suction chamber 22 below the upper reach of the conveyor 12 draws air into the row or group 19 of three successive suction ports 17 which are located beneath the trailing end T of the web 7*a*, i.e., the web 7*a* is advanced only by the conveyor 12 and the web 7*b* is advanced only by the row or group 18 of suction ports 17 in the conveyor 11. The main prime mover 43 drives the conveyor 13 at the speed of the conveyor 11 but the conveyor 13 does not participate in advancement of the web 7*a* and/or 7*b* toward the stacking station 29 because its row or group 21 of three suction ports 17 communicates with the respective suction chamber 22 but such suction chamber is sealed from the fan or pump by the valve 26. At such time, the motor 14 is caused to drive the transmission 16 in order to move the median conveyor 12 at a speed which is higher than the speed of the conveyors 11, 13 so that the trailing end T of the web 7*a* advances forwardly and away from the leader F of the (then) slower web 7*b* with attendant formation of the gap L. The motor 14 and the transmission 16 further accelerate a conveyor or a set of conveyors 31 which advance successive webs from the conveyors 11–13 to the stacking station 29, and the conveying elements of stacking mechanism at the station 29 are also accelerated, the same as the web 7*a* and conveyor or conveyors 31, to ensure that the operation of the stacking mechanism at the station 29 is always synchronized with the speed of the foremost web 7*a* which is on its way toward the station 29 and the leader of which is already in the process of being converted into a stack 32.

When the making of the gap L is completed (see FIGS. 3*a* and 3*b*), the valve 26 remains closed, the valve 23 remains open and the valve 24 is closed so that the median conveyor 12 can no longer attract and advance the web 7*a* The web 7*a* is then advanced solely by the conveyor or conveyors 31. The motor 14 is deactivated so that the conveyor 12, the conveyor or conveyors 31 and the conveying elements of stacking mechanism at the station 29 are again driven at the standard or average speed corresponding to the speed of the conveyors 11 and 13.

The next step involves activating the motor 27 and the transmission 28 so that the speed of the conveyor 12 is reduced to a speed less than that of the conveyors 11 and 13, i.e., the rows or groups 18 and 21 of perforations 17 in the conveyors 11, 13 begin to catch up with the perforations 17 of the row or group 19 in the conveyor 12. FIGS. 4*a* and 4*b* show an intermediate stage of the decelerating operation, and FIGS. 5*a* and 5*b* show the group 19 back in the starting position with reference to the groups 18 and 21. The valves 24 and 26 are then opened so that the three conveyors 11–13 cooperate in advancing the web 7*b* toward the stacking station 29. The valve 26 is closed and the web 7*b* is accelerated (to move its trailing end away from the leader of the next-following web, not shown) when the trailing end of the web 7*b* advances to a position close to the line 8 which is shown in FIG. 2*a*. The manner in which the line 8 is detected will be described with reference to FIG. 6. The means for monitoring the trailing ends of successive webs or the leaders of successive webs controls the operation of the means for opening or closing the valves 24, 26 and the operation of the motors 14 and 27. The motors 14 serves to accelerate the conveyor(s) 31 and the conveying elements of stacking mechanism at the station 29 in synchronism with the conveyor 12.

The stacking station 29 accommodates an elevator 33 which removes successive stacks 32 to provide room for fresh stacks, and the elevator 33 lowers successive freshly accumulated stacks 32 into the range of a mechanism 34, 36 which serves to transport successive stacks to storage, to a wrapping station or to another destination. Reference may be had, for example, to the aforementioned commonly owned U.S. Pat. No. 4,854,932 which describes and shows a stacking station and a mechanism which can remove freshly assembled stacks from such station.

The median conveyor 12 is designed to engage successive webs of the series of webs 7*a*, 7*b* . . . at least when the trailing end of a web (7*a* in FIG. 2*a*) reaches the group 19 of suction ports 17. The groups 18, 19, 21 of suction ports 17 in the conveyors 11, 12, 13 are staggered in such a way that, if the group 21 is disconnected or sealed from the fan 37 (by the valve 26) and the valve 14 is open, the trailing end T of the web (7*a*) on the advancing means 9 is entrained and accelerated only by the conveyor 12 while the conveyor 11 advances the leader F of the next-following web (7*b*) at an average speed which is less than the speed of the accelerated conveyor 12.

The purpose of the conveyor 13 is to cooperate with the conveyor 11 in advancing the web 7*b* in the direction of arrow 111, without lateral stray movement, during return movement of conveyor 12 to its starting position.

Figure 6:
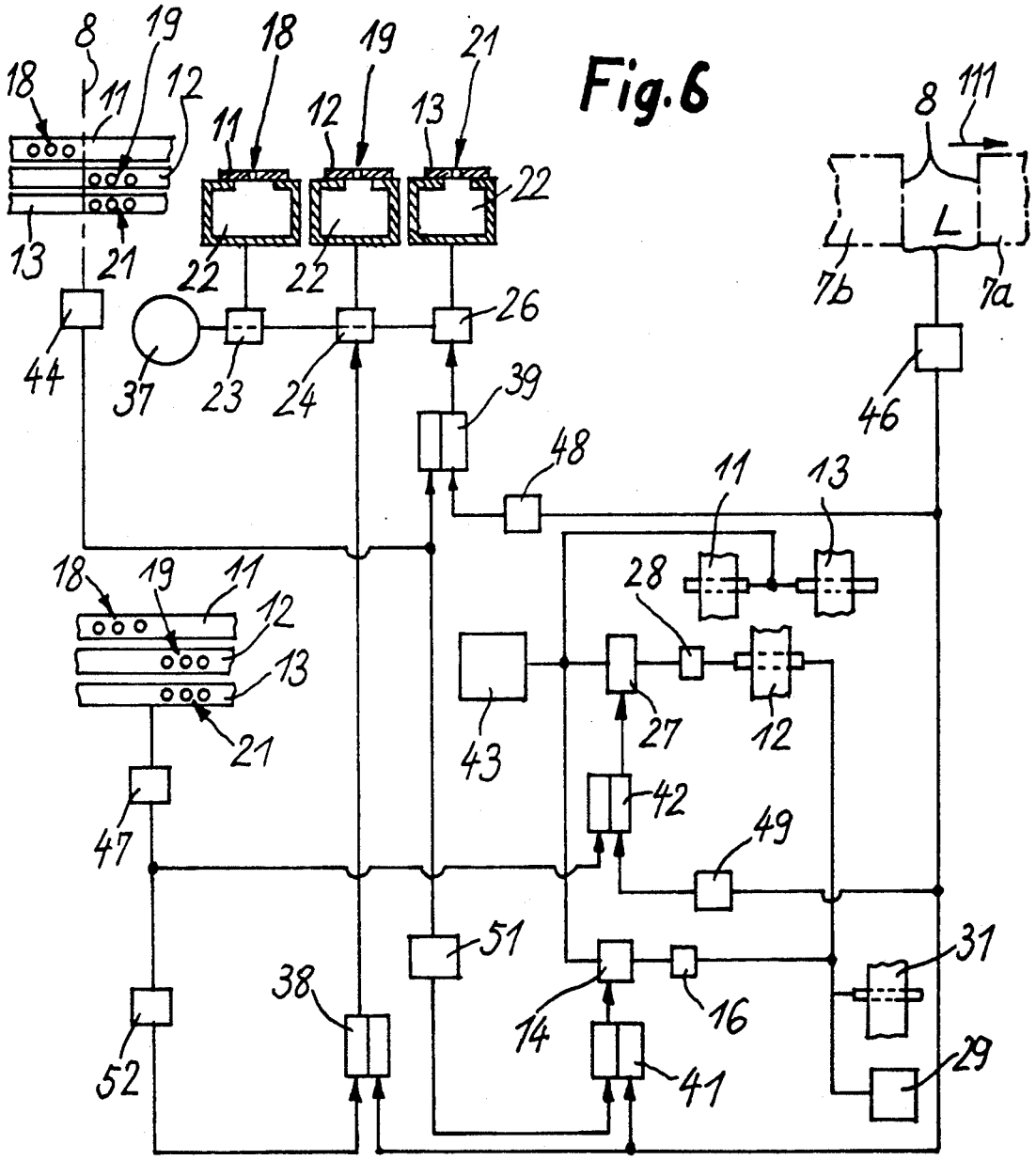
* and FIG. 6 is a circuit diagram of the control system of the improved apparatus.

FIG. 6 shows the control circuit of the improved apparatus.

When the valves 23, 24, 26 are open, the suction chambers 22 for the respective conveyors 11, 12, 13 are connected to the intake of the fan 37. The valves 24 and 26 are controlled by switching elements in the form of memories 38 and 39 (e.g., flip-flop circuits), respectively. Additional switching elements in the form of memories 41 and 42 are provided for the motors 14 and 27, respectively. The main prime mover 43 of the apparatus serves to transmit motion to the conveyors 11, 12, 13 and 31 as well as to the conveying elements at the stacking station 29 at a basic speed. The motor 14 can be started to override the prime mover 43 by driving the conveyors 12, 31 and the conveying elements at the stacking station 29 at a higher speed through the medium of the differential or transmission 16, and the motor 27 can be started to override the prime mover 43 and to drive the conveyor 12 at a reduced speed by way of the differential or transmission 28.

In order to activate the valves 23, 24, 26 and the motors 14, 27, the control circuit of FIG. 6 further comprises rotary pulse generators 44, 46, 47 which respectively monitor the presence or absence of the cut between successive webs 7*a*, 7*b* (line 8 in FIG. 2*a*), the width of the gap L between the webs 7*a*, 7*b*, and the conveyors 11, 13. The pulse generators 44, 46 and 47 can be of the type known as IG 17 ABO 00 10-E4-M3-OP distributed by the firm SICO, Federal Republic Germany. The control circuit further comprises a time delay relay 48 at one input of the memory 39, a time delay relay 49 at one input to the memory 42, a time delay relay 51 at another input to the memory 39, and a time delay relay 52 at one input to the memory 38.

The mode of operation of the control circuit of FIG. 6 is as follows:

The control cycle for the conveyors 11, 12 and 13 is started at the instant when the cut (line 8 in FIG. 2) between the webs 7*a* and 7*b* reaches the position of FIG. 6, namely between the row 18 of ports 17 in the conveyor 11 on the one hand and the rows 19, 21 of ports 17 in the conveyors 12, 13 on the other hand. It will be recalled that the cut (line 8) is made by a knife at the severing station 6. The pulse generator 44 determines the locus of the cut in the web 1, i.e., the length of the web 7*a* between the severing station and the location of the line 8 in FIG. 6, in dependency upon the desired number of panels in a stack 32. When the line 8 reaches the position of FIG. 6, the entire web 7*a* (which is composed of a selected number of coherent loops or sections 2) has advanced beyond such line but its trailing end T is still immediately adjacent the leader F of the web 7*b*. The pulse generator 44 then transmits a signal to the erasing input of the memory 39 which was set during the preceding cycle so that the signal at the output of the memory 39 disappears and the valve 26 is closed, i.e., the suction ports 17 forming the row 21 of such ports in the conveyor 13 are ineffective in that they no longer attract the web 7*a*.

The valve 24 is open due to appropriate setting of corresponding memory 38 during the preceding cycle, and the valve 23 is open at all times. Therefore, the rows 18 and 19 of suction ports 17 in the conveyors 11, 12 are connected to the fan 37. In order to ensure that the valve 26 is closed in good time, the time delay relay 51 sets the memory 41 which activates the motor 14 only after the valve 26 is closed. The web 7*b* is advanced at the basic speed which is determined by the main prime mover 43; this prime mover drives the conveyor 11 which attracts the web 7*b*. The conveyor 13 is also driven but it does not attract the web 7*b*. The conveyor 12 attracts the web 7*a* and advances it at the higher speed of the motor 14. Thus, the conveyors 11, 12 cooperate to establish the gap L between the trailing end T of the preceding web 7*a* and the leader L of the next-following web 7*b*. The motor 14 also accelerates the conveyor 31 and the conveying elements at the stacking station 29.

The pulse generator 46 monitors the operation of the motor 14 and generates a preselected number of pulses (corresponding to the desired width of the gap L) to thereupon transmit a signal to the erasing input of the memory 38 which closes the valve 24 for the median conveyor 12. At the same time, the signal from the pulse generator 46 effects stoppage of the motor 14 because such signal is transmitted to the erasing input of the memory 41. Thus, the motor 14 ceases to drive the conveyors 12, 31 and the conveying elements at the stacking station 29 at a higher speed. The conveyor 31 and the conveying elements at the station 29 are again driven at a speed which is determined by the main prime mover 43.

The valve 23 remains open and the valve 24 remains closed when the webs 7*a*, 7*b* reach the positions of FIGS. 4*a* and 4*b*. The time delay relay 48 then transmits a delayed signal from the pulse generator 46 to the setting input of the memory 39 which opens the valve 26 for the conveyor 13. The time delay relay 49 transmits a delayed signal from the pulse generator 46 to the setting input of the memory 42 which transmits an activating signal to the motor 27 so that the transmission or differential 28 begins to drive the conveyor 12 (which does not pull the web 7*a* and/or 7*b* because the valve 24 is closed) so that the conveyor 12 is driven at a speed less than that of the conveyors 11 and 13. This enables the rows 18 and 21 of suction ports 17 in the two outer conveyors 11, 13 to catch up with the row 19 of suction ports 17 in the median conveyor 12, i.e., the conveyor 12 reassumes a predetermined starting position relative to the conveyors 11 and 13. Such situation is shown in FIGS. 5*a* and 5*b*. The pulse generator 47 monitors the conveyors 11 to 13 and transmits a signal to the erasing input of the memory 42 to deactivate the motor 27 for the conveyor 12 when the latter reassumes its starting position with reference to the conveyors 11 and 13. The conveyor 12 is thereupon driven at the speed which is determined by the main prime mover 43. The time delay relay 52 transmits a delayed signal from the pulse generator 47 to the setting input of the memory 38 which opens the valve 24 so that the conveyor 12 thereupon cooperates with the conveyors 11 and 13 in advancing the web 7*b* toward the conveyor or conveyors 31. It will be seen that, as soon as the motor 27 is deactivated, all three conveyors 11, 12, 13 are driven (by the main prime mover 43) at the standard speed and all of these conveyors cooperate in advancing the web 7*b* toward the stacking station 29, i.e., into the range of the conveyor or conveyors 31. Such situation remains unchanged until the pulse generator 44 transmits a signal denoting the arrival of the trailing end of the web 7*b* at the monitoring station.

An advantage of the improved apparatus is that the accelerating means for successive discrete webs of the series of such webs does not occupy additional space in the apparatus. This is due to the fact that the conveyor 12 of the accelerating means is incorporated into the advancing means 9, i.e., the conveyor 12 can be used to advance the webs at the speed of the other two conveyors 11, 13 or to temporarily advance the trailing end T of the adjacent web (7*a*, 7*b*, etc.) at a higher speed in order to establish a gap L of desired width. Since the conveying elements of stacking mechanism at the station 29 and the conveyor or conveyors 31 are accelerated with the median conveyor 12 of the advancing means 9, the fact that the speed of a web is increased for the purpose of forming a gap does not affect the stacking of the front portion of such web at the station 29.

It is within the purview of the invention to omit the motor 27 and the transmission or differential 28 and to simply continue to drive the median conveyor 12 at an elevated speed subsequent to closing of the valve 24 until the group 19 of suction ports 17 reassumes the predetermined starting position relative to the groups 18 and 21 of suction ports 17 in the conveyors 11 and 13. The illustrated apparatus (employing the parts 27, 28) is preferred at this time because the median conveyor 12 can reassume its predetermined starting position with reference to the conveyors 11, 13 within a shorter interval of time. The conveyor 12 thereupon cooperates with the conveyors 11, 13 to advance a web above the conveyors at a speed which is determined by the main prime mover 37.

Another important advantage of the improved apparatus is that the inertia of the accelerating means including the conveyor 12 is negligible. Furthermore, the operation of the motors 14, 27 and of the main prime mover 37 can be synchronized by resorting to simple monitoring and regulating means. In addition, the apparatus can transport discrete webs at a speed much higher than in heretofore known apparatus which are provided with means for moving successive webs of a series of discrete webs away from each other ahead of a mechanism which stacks webs in zig-zag formation. In fact, the improved apparatus can be used with equal advantage at speeds which are much higher than presently acceptable speeds, i.e., at speeds higher than those which are permissible in view of the ability of the zig-zag forming means 3, 4 and/or the stacking means at the station 29 to perform their respective functions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for processing a series of elongated webs each of which has a leader and a trailing end, comprising means for advancing the series of webs in a predetermined direction along a predetermined path wherein the leader of each following web is adjacent the trailing end of the respective preceding web, said advancing means comprising means for accelerating successive webs of the series in a predetermined portion of said path to thereby establish a gap of predetermined width between the trailing end of the accelerated web and the leader of the next-following web, said advancing means including a plurality of foraminous endless belt conveyors and one of said conveyors forming part of said accelerating means, said conveyors having parallel web-attracting reaches provided with groups of suction ports and said groups of suction ports being staggered relative to each other in the region of the trailing ends of webs having trailing ends in said predetermined portion of said path, the group of suction ports in said one conveyor being located downstream of the groups of suction ports in each other conveyor prior to acceleration of a web of the series of webs.

2. The apparatus of claim 1, further comprising means for providing successive webs of the series with sections in zig-zag formation in a second portion of said path upstream of said predetermined portion.

3. The apparatus of claim 1, wherein said accelerating means includes means for engaging successive webs of the series at least in the regions of trailing ends of the respective webs, and means for periodically activating said accelerating means.

4. The apparatus of claim 1, further comprising variable-speed means for treating successive webs in a further portion of said path downstream of said predetermined portion, said accelerating means further comprising means for periodically varying the speed of said one conveyor and of said treating means.

5. The apparatus of claim 1, wherein said advancing means comprises three conveyors including said one conveyor and two additional conveyors flanking said one conveyor.

6. The apparatus of claim 1, wherein each of said groups includes at least one row of three suction ports.

7. The apparatus of claim 6, wherein the ports of each of said rows are spaced apart from each other in said predetermined direction.

8. Apparatus for processing a series of elongated webs each of which has a leader and a trailing end, comprising means for advancing a series of webs in a predetermined direction along a predetermined path wherein the leader of each following web is adjacent the trailing end of the respective preceding web, said advancing means comprising means for accelerating successive webs of the series in a predetermined portion of said path to thereby establish a gap of predetermined width between the trailing end of the accelerated web and the leader of the next-following web, said advancing means including three foraminous endless belt conveyors and one of said conveyors forming part of said accelerating means, the other two conveyors flanking said one conveyor and said conveyors having parallel elongated web-attracting reaches provided with groups of suction ports, said suction ports being staggered relative to each other in the region of the trailing ends of webs having trailing ends in said predetermined portion of said path, said accelerating means further comprising means for driving said one conveyor at a plurality of speeds including a higher speed exceeding the speed of said other two conveyors and a lower speed less than the speed of said other two conveyors.

9. The apparatus of claim 8, wherein said advancing means further comprises means for-driving said additional conveyors at a speed less than said higher speed but exceeding said lower speed.

10. The apparatus of claim 9, wherein the means for driving said one conveyor includes means for advancing the group of suction ports in said one conveyor forwardly and beyond the other groups of suction ports from a predetermined starting position while said one conveyor is driven at said higher speed and for returning the group of suction ports in said one conveyor to said predetermined starting position relative to the groups of suction ports in said additional conveyors as a result of driving said one conveyor at said lower speed.

11. Apparatus for processing a series of elongated webs each of which has a leader and a trailing end, comprising means for advancing a series of webs in a predetermined direction along a predetermined path wherein the leader of each following web is adjacent the trailing end of the respective preceding web, said advancing means comprising means for accelerating successive webs of the series in a predetermined portion of said path to thereby establish a gap of predetermined width between the trailing end of the accelerated web and the leader of the next-following web, said advancing means including three foraminous endless belt conveyors and one of said conveyors forming part of said accelerating means, the other two conveyors flanking said one conveyor and said conveyors having parallel elongated web-attracting reaches provided with groups of suction ports, said suction ports being staggered relative to each other in the region of the trailing ends of webs having trailing ends in said predetermined portion of said path, the groups of suction ports in said one conveyor and in one of said other two conveyors being located downstream of the group of suction ports in the other of said other two conveyors.

12. The apparatus of claim 11, wherein said advancing means further comprises a suction generating device in uninterrupted communication with the group of suction ports in said one additional conveyor.

13. The apparatus of claim 12, wherein said advancing means further comprises at least one suction generating device and means for periodically connecting said at least one suction generating device with the groups of suction ports in said one conveyor and said other additional conveyor.

* * * * *